US007093743B2

(12) United States Patent
Oouchi et al.

(10) Patent No.: US 7,093,743 B2
(45) Date of Patent: Aug. 22, 2006

(54) PNEUMATICALLY OPERATED POWER TOOL HAVING MECHANISM FOR CHANGING COMPRESSED AIR PRESSURE

(75) Inventors: Haruhiko Oouchi, Hitachinaka (JP); Shoichi Hirai, Hitachinaka (JP); Michio Wakabayashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/963,509

(22) Filed: Oct. 14, 2004

(65) Prior Publication Data

US 2005/0077064 A1 Apr. 14, 2005

(30) Foreign Application Priority Data

Oct. 14, 2003 (JP) ..... P2003-353352

(51) Int. Cl.
*B25C 1/04* (2006.01)

(52) U.S. Cl. ..... 227/130; 81/430; 81/433; 81/435

(58) Field of Classification Search ..... 227/130; 81/430, 433, 435; 173/218, 220
See application file for complete search history.

(56) References Cited

U.S. PATENT DOCUMENTS 3,850,359 A * 11/1974 Obergfell ..... 227/10
3,948,328 A * 4/1976 Hiraoka et al. ..... 173/181
3,983,947 A * 10/1976 Wills et al. ..... 173/169
4,196,833 A * 4/1980 Haytayan ..... 227/8
4,522,269 A * 6/1985 Adman et al. ..... 173/177
4,932,480 A * 6/1990 Golsch ..... 173/210
5,782,395 A * 7/1998 Sauer ..... 227/130
5,873,510 A * 2/1999 Hirai et al. ..... 227/130
6,026,713 A 2/2000 Ohmori et al.
6,039,231 A * 3/2000 White ..... 227/130
6,152,245 A * 11/2000 Nilsson ..... 173/218

FOREIGN PATENT DOCUMENTS

JP 11-300639 11/1999

* cited by examiner

*Primary Examiner*—Scott A. Smith
*Assistant Examiner*—Brian Nash
(74) *Attorney, Agent, or Firm*—Antonelli, Terry, Stout and Kraus, LLP.

(57) ABSTRACT

A pneumatically operated power tool such as a screw driver, a nail gun and an impact wrench those being driven by a pneumatic pressure. A pressure reduction valve is provided between a connector connected to a compressor and a compressed air chamber defined in an outer frame of the power tool for supplying a pressure lower than the pressure at the connector to the compressed air chamber. A passage section is provided independently of the pressure reduction valve and communicating the connector with the compressed air chamber. A valve member is disposed at the passage section for selectively applying compressed air from the connector to the compressed air chamber directly through the passage section.

8 Claims, 5 Drawing Sheets

PNEUMATICALLY OPERATED POWER TOOL HAVING MECHANISM FOR CHANGING COMPRESSED AIR PRESSURE

BACKGROUND OF THE INVENTION

The present invention relates to a pneumatically operated power tool such as a screw driver, a nail gun and an impact wrench, and more particularly, to a mechanism for changing compressed air pressure disposed in an outer frame of the pneumatically operated power tool.

A screw driver is a typical example of a pneumatically operated power tool which provides an axially driving force by a piston and rotational force by a pneumatic motor for screwing a threaded fastener into a woody member a gypsum board, and a steel plate or the like. Compressed air is a power source for rotating the pneumatic motor and for axially moving the piston by way of a rotary member and a rotation slide member. The rotary member is rotationally driven by the pneumatic motor, and the rotation slide member is axially movable relative to the rotary member and is rotatable together with the rotary member. The piston is connected to the rotation slide member. A driver bit engageable with a groove of a screw head is connected to the piston. Such arrangement is disclosed in U.S. Pat. No. 6,026,713 and laid open Japanese Patent Application Publication No. H11-300639.

If the fastening target is a metal plate, screw driving energy may vary depending on a thickness and hardness of the metal plate. Screw fastening cannot be completed if the tip end of the screw cannot be penetrated through the metal plate. Taking this into consideration, sufficiently high pressure level of the compressed air is set in order to generate sufficient driving force capable of completing screw fastening with respect to the thick or high hardness steel plate.

However, if this high pressure level is applied to the screw fastening with respect to a thin or low hardness steel plate, excessive driving energy is imparted on the screw. This cannot form a complementary female thread in the steel plate. Thus, screw fastening cannot be realized or becomes ineffective. In other words, incomplete screw fastening may result in case of application of insufficient pressure level, and excessive screw fastening may result such as sinking of a screw head into a surface of the workpiece in case of the application of excessive pressure level.

In order to overcome this drawback, is required a control or adjustment to a pressure level of the compressed air depending on the material, thickness, and hardness of the workpiece to be fastened with the screw. To this effect, a pressure reduction valve is employed. The pressure reduction valve is normally located away from a working spot, since the pressure reduction valve is generally equipped at a compressor or is disposed solely near the compressor. Therefore, if the driving power different from the present driving power is needed for the subsequent screw fastening operation, an operator must walk to the compressor to adjust the pressure reduction valve. In order to avoid this cumbersome adjustment work, a commercially available pressure reduction valve is incorporated as a driving force adjuster at a body of the screw driver.

The adjuster does not perform a step-wise adjustment but performs a single step form or continuous adjustment. For the adjustment, an adjustment knob is rotated about its axis. However, the rotating manipulation of the knob does not promptly set the desired pressure level. Thus, such adjuster does provide insufficient operability, particularly if the pressure level must be frequently changed for the fastening different kinds of the workpieces with the fasteners. The same is true with respect to other pneumatically operated power tool such as a pneumatically operated nail gun and an impact wrench.

SUMMARY OF THE INVENTION

It is an object of the present invention to overcome the above-described problems and to provide an improved pneumatically operated power tool having a mechanism for changing compressed air pressure capable of performing prompt pressure change with a simple manipulation so as to promptly provide a desired driving force in conformance with a kind of workpiece without insufficient driving or without excessive driving.

This and other objects of the present invention will be attained by a pneumatically operated power tool including an outer frame, a driving components, a pressure reduction valve, a passage section, and a valve member. The outer frame has a compressed air intake portion and defines therein a compressed air chamber. The driving components are disposed in the outer frame and are driven by a compressed air in the compressed air chamber. The pressure reduction valve allows a compressed air to flow from the air intake portion to the compressed air chamber and to reduce a compressed air pressure when the compressed air is flowed through the pressure reduction valve. The passage section is provided independently of the pressure reduction valve and communicates the air intake portion with the compressed air chamber. The valve member is disposed at the passage section and is linearly movable between a first position and a second position. In the first position, the communication at the passage section between the air intake portion and the compressed air chamber is blocked whereby the pressure reduction valve performs its inherent pressure reducing operation. In the second position the air intake portion is communicated with the compressed air chamber at the passage section.

In another aspect of the invention, there is provided a pressure changing mechanism including the pressure reduction valve, the passage section, and the valve member.

In still another aspect of the invention, there is provided a pneumatically operated power tool including the outer frame and the driving components, a pressure reduction valve, and a change-over mechanism. The pressure reduction valve allows a compressed air to flow from the air intake portion to the compressed air chamber and to reduce a compressed air pressure when the compressed air is flowed through the pressure reduction valve. The change-over mechanism is in communication with the pressure-reduction valve. The change-over mechanism provides a first position to connect the pressure reduction valve to an atmosphere for supplying a compressed air from the intake portion to the compressed air chamber through an operation of the pressure reduction valve and a second position to connect the pressure reduction valve to the compressed air chamber for making the pressure reduction valve inoperative.

In still another aspect of the invention, there is provided a pressure changing mechanism including the latter pressure reduction valve, and a change-over mechanism.

DETAILED DESCRIPTION OF THE PREFERRED EMBODIMENTS

A pneumatically operated power tool according to a first embodiment of the present invention will be described with reference to FIGS. 1 through 4. The first embodiment pertains to a screw driver.

Figure 1:
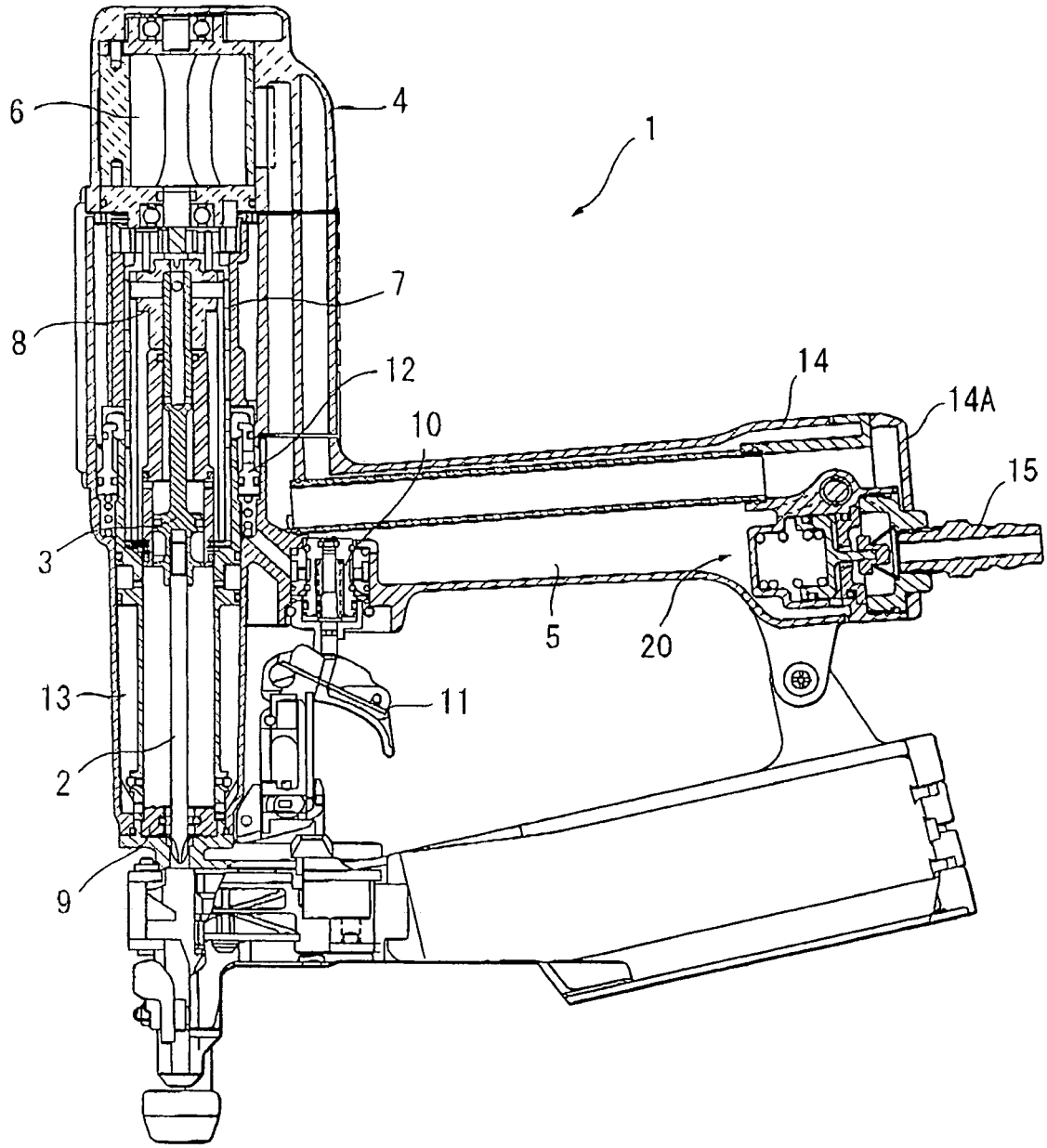
FIG. 1 is a cross-sectional view showing a pneumatically operated screw driver incorporating a mechanism for changing compressed air pressure according to a first embodiment of the present invention.

As shown in FIG. 1, a pneumatically operated screw driver 1 includes a driver bit 2 engageable with a groove formed in a head of the faster (not shown). The driver bit 2 is connected to a piston 3 which is driven in an axial direction of the drive bit 2 upon application of a pneumatic pressure. Inside an outer frame 4, a compressed air chamber 5 is defined in which a compressed air supplied from an external compressor (not shown) is accumulated. Further, a pneumatic motor 6 is provided for rotating a rotary member 7. A rotation slide member 8 is axially movable relative to the rotary member 7, and is rotatable together with the rotation of the rotary member 7. The compressed air is a power source for rotating the pneumatic motor 6 and for axially moving the rotation slide member 8.

The piston 3 is connected to the rotation slide member 8. Thus, the driver bit 2 is axially movable while being rotated about its axis for screwing the fastener into a target. Further, a bumper 9 is provided so as to absorb kinetic energy of the piston 3 moving to its bottom dead center. An operation valve 10 associated with a trigger 11 is provided for opening a main valve 12 in order to apply pneumatic pressure onto the rotation slide member 8 and to the pneumatic motor 6.

The screw driver 1 also includes a return chamber 13 to which a compressed air is accumulatable for applying compressed air to the piston 3 in order to move the piston 3 and the driver bit 2 to their initial positions. Accumulation of the compressed air into the return chamber 13 is started when the piston 3 is about to reach its bottom dead center. When the screw fastening operation is terminated upon abutment of the piston 3 onto the bumper 9, the compressed air accumulated in the return chamber 13 will be applied to an opposite side of the piston 3 so as to return the piston 3 and the driver bit 2 to their original positions. The outer frame 4 also provides a handle 14 in which the compressed air chamber 5 is provided.

Figure 2:
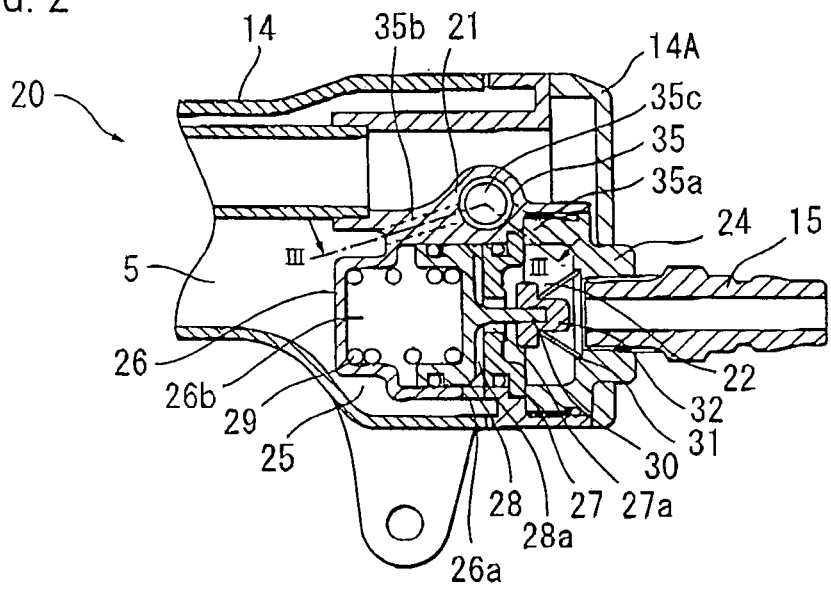
FIG. 2 is an enlarged cross-sectional view showing the mechanism for changing compressed air pressure according to the first embodiment.

The handle 14 has an end wall 14A provided with a connector 15 in communication with the compressor (not shown). Inside the handle 14, that is, in the compressed air chamber 5, a pressure changing mechanism 20 is provided. As shown in FIG. 2, the pressure changing mechanism 20 includes an attachment segment 21, and an end cap 24 disposed at the end wall 14A to fix the attachment segment 21 to the handle 14. The end cap 24 supports the connector 15. The attachment segment 21 includes a cup-shaped cylinder section 26 and a passage section 35.

The pressure changing mechanism 20 includes pressure reduction valve 25 including the cup shaped cylinder section 26, a holder 27, a piston 28, a first spring 29, a valve stem 30, a second spring 31, and a valve head 32. The holder 27 is disposed at an open end of the cup shaped cylinder section 26 and is formed with a through-hole 27*a*. At the open end of the cylinder 26, a communication hole 26*a* in communication with the compressed air chamber 5 is formed.

The piston 28 is slidably movably disposed in the cylinder section 26. The piston 28 has one end surface in confrontation with the holder 27 and serves as a pressure receiving surface. The one end surface is formed with a diametrically extending cruciform grooves 28*a* open to the communication hole 26*a*. When the one end surface is in contact with the holder 27, the cruciform grooves 28*a* only serve as the pressure receiving surface. Further, the valve stem 30 extends from the one end surface and through the through-hole 27*a*. An annular space is provided between the valve stem 30 and the through-hole 27*a*. The valve head 32 is fixed at a free end of the valve stem 30 for closing the through-hole 27*a* when the piston 28 moves toward the bottom of the cylinder section 26, The cylinder section 26 and the piston 28 define in combination a cylinder chamber 26*b* in communication with an atmosphere (not shown). Further, a compressed air inlet chamber 22 in communication with the connector 15 is defined between the end cap 24 and the holder 27. The first spring 29 is housed in the cylinder chamber 26*b* for urging the piston 28, the valve stem 30 and the valve head 32 toward the connector 15. The second spring 31 is interposed between the end cap 24 and the valve head 32 for supporting the valve head 32 and biasing the valve head 32 toward the holder 27.

Figure 3:
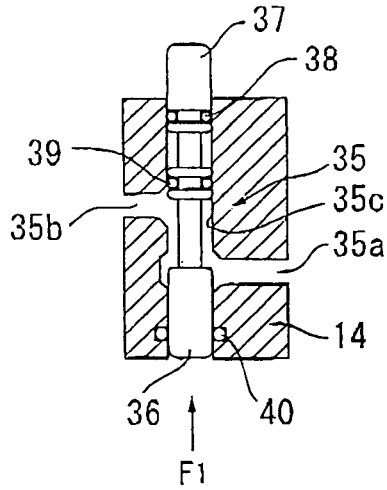
FIG. 3 is a cross-sectional view taken along the line III—III of FIG. 2 and showing an open state of a passage in the first embodiment.
Figure 4:
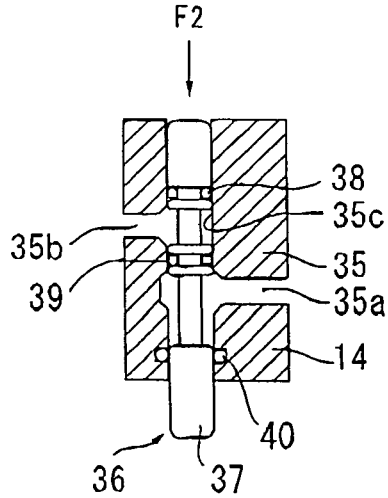
FIG. 4 is a cross-sectional view taken along the line III—III of FIG. 2 and showing a closed state of a passage in the first embodiment.

As shown in FIGS. 3 and 4, the passage section 35 is formed with a central passage 35*c*, a first communication passage 35*a* branched from the central passage 35*c* and open to the compressed air inlet chamber 22, and a second communication passage 35*b* branched from the central passage 35*c* and open to the compressed air chamber 5. A valve 36 extends through the central passage 35*c*. The valve 36 includes a valve stem 37, and O-rings 38, 39 assembled at an outer peripheral surface of the valve stem 37. Another O-ring 40 is assembled at the handle 14. These O-rings 38, 39, 40 are adapted for sealing between the valve stem 37 and the central passage 35*c*. When the valve stem 37 is at a first position shown in FIG. 3 upon application of a linear pushing force F1, the first and second communications passages 35*a* and 35*b* are communicated with each other for leading the compressed air from the connector 15 directly into the compressed air chamber 5. On the other hand, when the valve stem 37 is at a second position shown in FIG. 4 upon application of a linear pushing force F2, the communication between the first and second communications passages 35*a* and 35*b* is blocked by the O-ring 39.

In operation, assuming that the valve 36 is positioned at the second position shown in FIG. 4 where direct introduction of the compressed air from the connector 15 to the compressed air chamber 5 through the communication passages 35*a* to 35*c* is blocked by the valve 36. If the compressor is not operated, and if no compressed air is held in the compressed air chamber 5, the piston 28 is moved to abut the holder 27 by the biasing force of the first spring 29. In this state if compressed air is supplied from the connector 15, the compressed air is flowed into the compressed air chamber 5 through the through-hole 27*a*, the cruciform grooves 28*a*, and the communication hole 26*a*. Therefore, pressure in the compressed air chamber 5 is increased.

As a result of the pressure increase, the piston 28 is gradually moved toward the bottom of the cylinder section 26 against the biasing force of the first spring 29, because the compressed air chamber 5 is communicated with the space defined between the holder 27 and the piston 28 through the communication hole 26*a* and the cruciform groove 28*a*. When the pressure in the compressed air inlet chamber 22 reaches a predetermined pressure set by the pressure reduction valve 25, the piston 28 is further moved toward the bottom of the cylinder section 26, so that the valve head 32 closes the through-hole 27*a*. Thus, the pressure level in the compressed air chamber 5 can be maintained by the pressure reduction valve 25.

If the pressure in the compressed air chamber 5 is lowered, the piston 28 is moved toward the connector 15 by the biasing force of the first spring 29. As a result, the valve head 32 opens the through-hole 27*a*. Thus, a new compressed air can be introduced into the compressed air chamber 5 through the pressure reduction valve 25, In this way, the pressure in the compressed air chamber 5 can be maintained at a predetermined pressure level lower than the pressure level in the connector 15.

On the other hand, if the valve stem 37 is moved to the first position shown in FIG. 3 by simply pushing the valve stem 37, the compressed air from the connector 15 is directly flowed into the compressed air chamber 5 through the communication passages 35*a*, 35*b*, 35*c* without pressure reduction. Because the high pressure is applied to the pressure receiving surface (facing the holder 27) of the piston 28, the piston 28 is moved toward the bottom of the cylinder section 26. As a result, closing state of the through-hole 27*a* is maintained by the valve head 32 as long as the valve stem 37 is positioned at its first position shown in FIG. 3. In this case, the compressed air chamber has a pressure level the same as that at the connector 15.

In this way, pressure level in the compressed air chamber 5 can be promptly changed or switched by simple pushing operation of the valve stem 37, and consequently, different driving power can be promptly selectively provided dependent on the kind of the workpiece.

Figure 5:
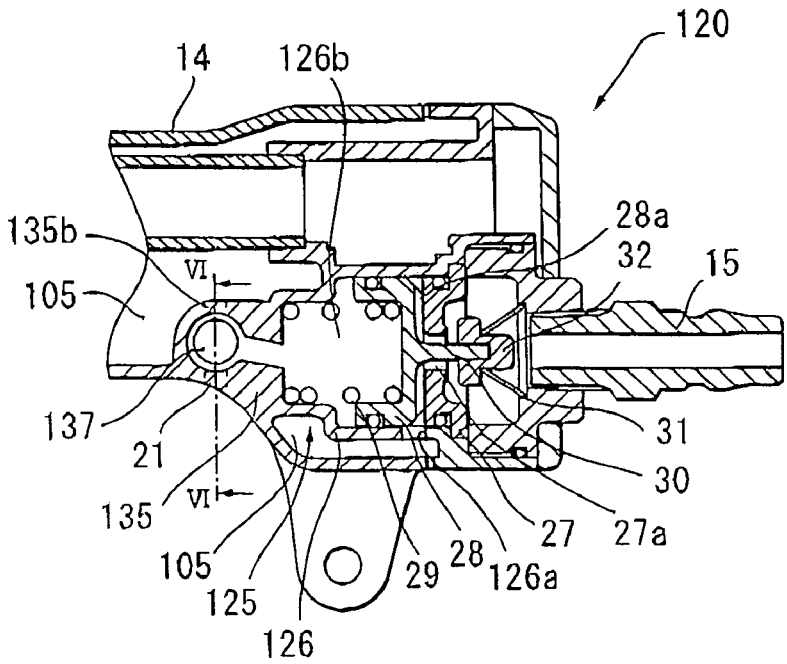
FIG. 5 is an enlarged cross-sectional view showing a mechanism for changing compressed air pressure according to a second embodiment of the present invention.
Figure 6:
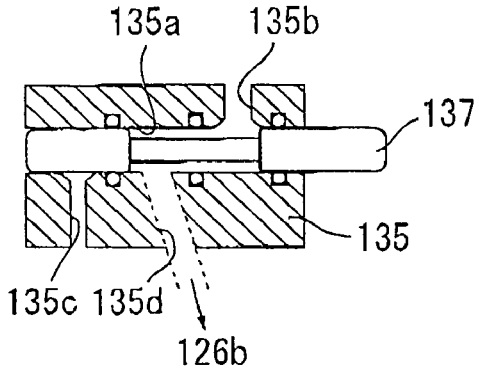
FIG. 6 is a cross-sectional view taken along the line VI—VI of FIG. 5 for showing a first position of a change-over valve in the second embodiment.
Figure 7:
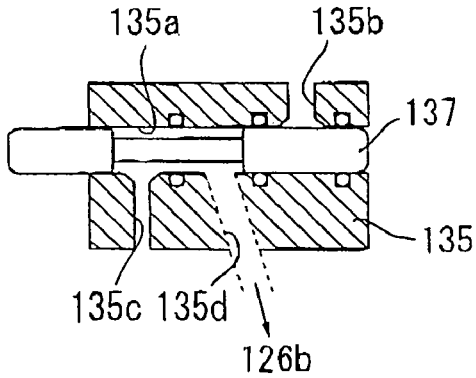
FIG. 7 is a cross-sectional view taken along the line VI—VI of FIG. 5 for showing a second position of a change-over valve in the second embodiment.

FIGS. 5 through 7 show a mechanism 120 for changing a compressed air pressure according to the second embodiment of the present invention wherein like parts and components are designated by the same reference numerals and characters as those shown in the first embodiment.

In the first embodiment, the cylinder chamber 26*b* is always communicated with the atmosphere. On the other hand, in the second embodiment, a cylinder chamber 126*b* is communicated with either a compressed air chamber 105 or an atmosphere, by the pushing operation of a valve stem 137. That is, a passage section 135 is formed with a central passage 135*a*, a first passage 135*b* branched from the central passage 135*a* and in communication with the compressed air chamber 105, a second passage 135*c* branched from the central passage 135*a* and in communication with an atmosphere, and a third passage 135*d* branched from the central passage 135*a* and in communication with the cylinder chamber 126*b*. A valve stem 137 extends through the central passage 135*a* for providing air communication between the compressed air chamber 105 and the cylinder chamber 126*b* while blocking communication between the compressed air chamber 105 and the atmosphere (FIG. 6), or between the cylinder chamber 126*b* and the atmosphere while blocking communication between the compressed air chamber 105 and the cylinder chamber 126*b* (FIG. 7).

In the state shown in FIG. 6, compressed air pressure in the compressed air chamber is applied to the cylinder chamber 126*b*. Therefore, the piston is urged toward the connector 15, to render the pressure reduction valve 125 inoperative. In the latter case, the compressed air from the connector 15 is delivered to the compressed air chamber 105 through the through-hole 27*a*, the cruciform groove 28*a*, and the communication hole 126*a*, while the piston 28 is in abutment with the holder 27.

In the state shown in FIG. 7, the atmospheric pressure is applied to the cylinder chamber 126*b* to render the pressure reduction valve 125 operative. Accordingly, similar to the first embodiment, the compressed air pressure in the compressed air chamber 105 can be maintained lower than that at the connector 15. In the second embodiment, pressure level in the compressed air chamber 105 can be promptly changed or switched by simple pushing operation of the valve stem 137 similar to the first embodiment, and consequently, different driving power can be promptly selectively provided dependent on the kind of the workpiece.

Figure 8:
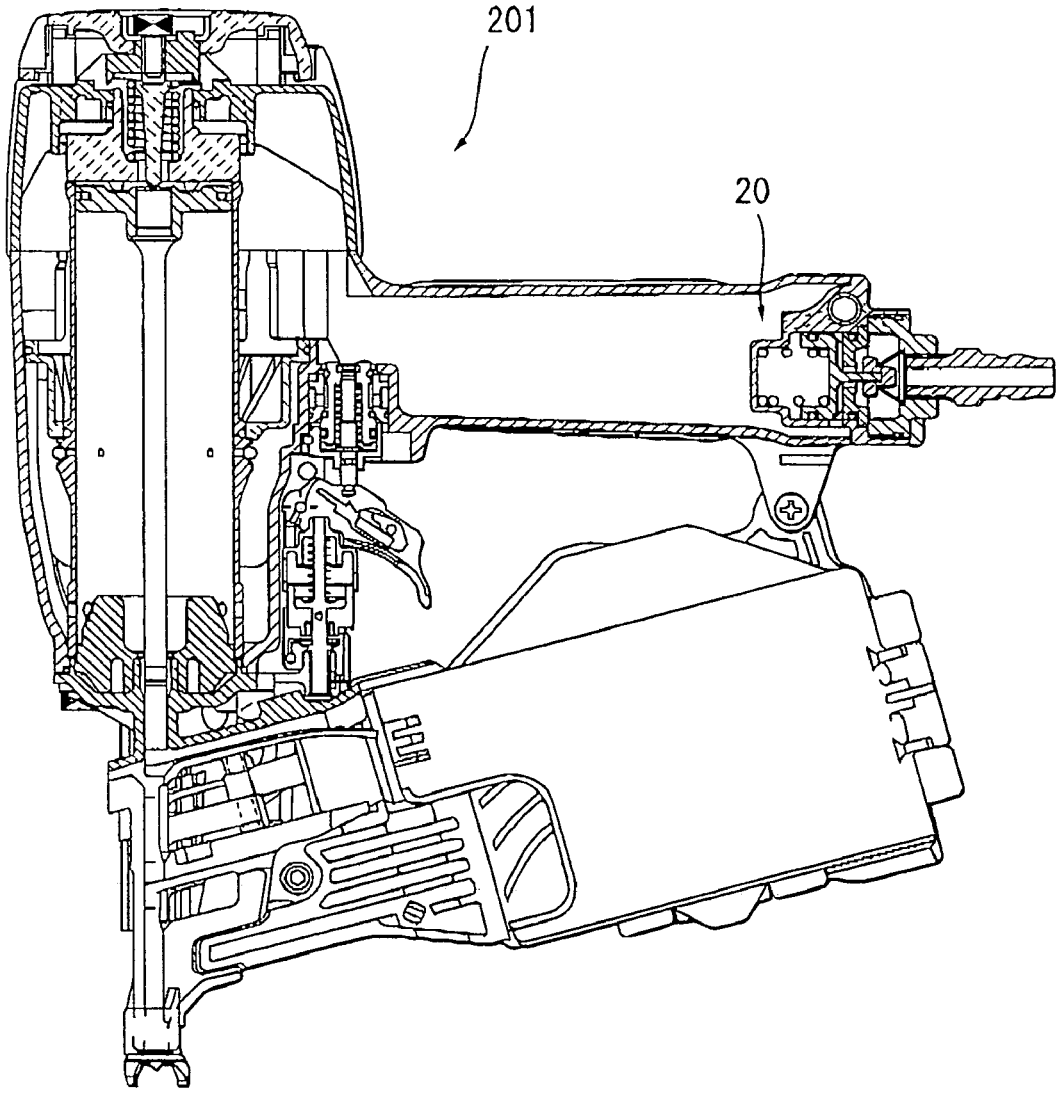
FIG. 8 is a cross-sectional view showing a pneumatically operated nail gun incorporating the mechanism for changing compressed air pressure according to the first embodiment.
Figure 9:
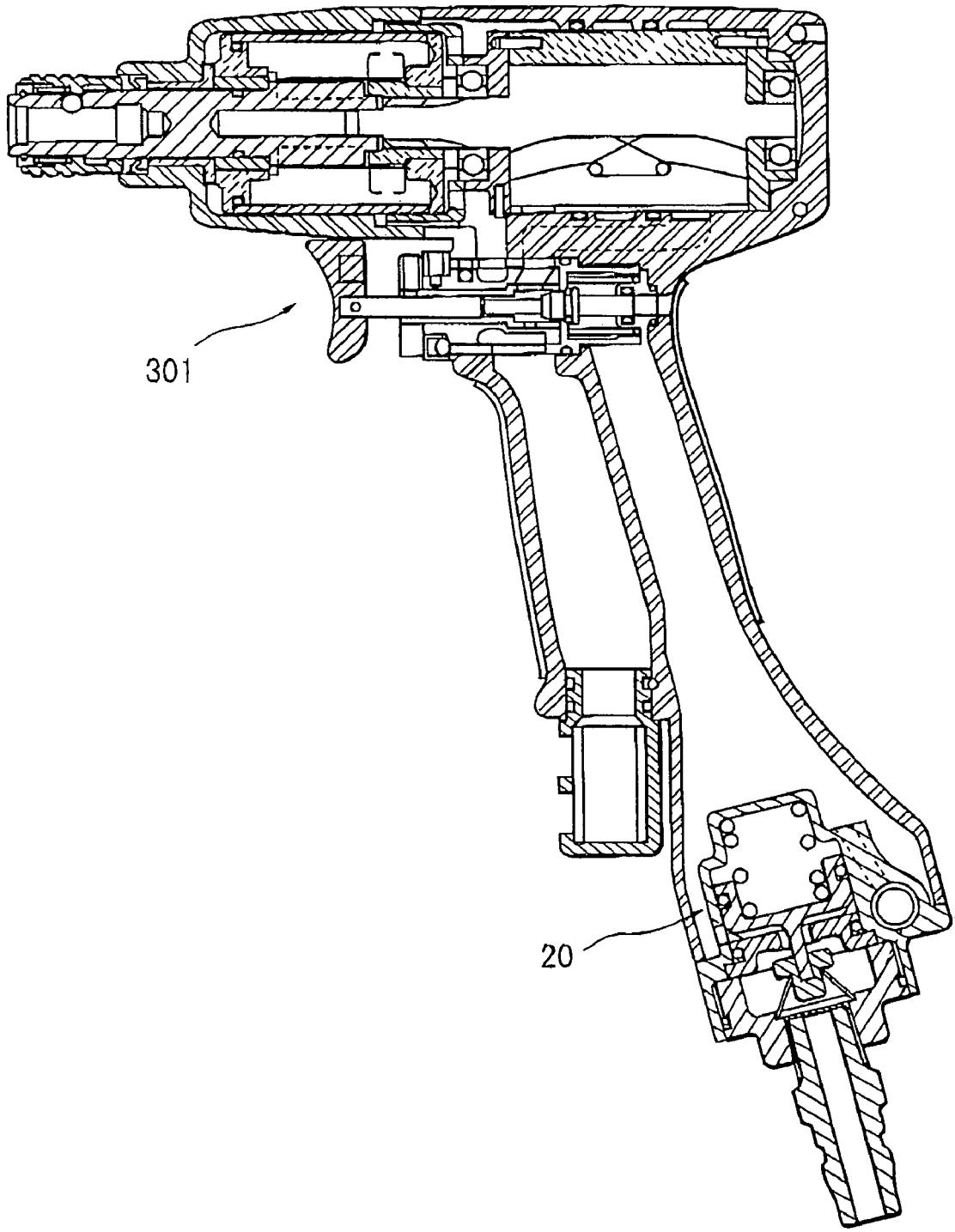
FIG. 9 is a cross-sectional view showing a pneumatically operated impact wrench incorporating the mechanism for changing compressed air pressure according to the first embodiment.

A pneumatically operated nail gun 201 and a pneumatically operated impact wrench 301 are shown in FIGS. 8 and 9, which are other examples of a pneumatically operated power tool. The nail gun 201 and the impact wrench 301 are respectively provided with the above-described pressure changing mechanism 20 associated with the connector and the compressed air chamber. It goes without saying that instead of the pressure changing mechanism 20, the pressure changing mechanism 120 in the second embodiment can also be incorporated into the nail gun 201 and the impact wrench 301.

While the invention has been described in detail and with reference to specific embodiments thereof, it would be apparent to those skilled in the art that various changes and modifications may be made therein without departing from the spirit and scope of the invention.

For example, the pressure reduction valve itself sets a single pressure level by the biasing force of the spring 29. However, an adjustment mechanism for changing the biasing force of the spring can be provided to the pressure reduction valve in order to provide a plurality of predetermined pressure levels. In the latter case, driving energy can be finely adjusted depending on various kinds of workpieces.

What is claimed is:

1. A pneumatically operated power tool comprising:

an outer frame having a compressed air intake portion and defining therein a compressed air chamber;

a driving components disposed in the outer frame and driven by a compressed air in the compressed air chamber;

a pressure reduction valve allowing a compressed air to flow from the air intake portion to the compressed air chamber and to reduce a compressed air pressure when the compressed air is flowed through the pressure reduction valve;

a passage section provided independently of the pressure reduction valve and communicating the air intake portion with the compressed air chamber; and a valve member disposed at the passage section and movable between a first position where the communication at the passage section between the air intake portion and the compressed air chamber is blocked, whereby the pressure reduction valve performs its inherent pressure reducing operation, and a second position where the air intake portion is communicated with the compressed air chamber at the passage section.

2. The pneumatically operated power tool as claimed in claim 1, wherein the pressure reduction valve comprises:

a cylinder section disposed in the compressed air chamber;

a piston disposed in the cylinder section and having a pressure receiving surface facing the intake portion, the piston being slidingly movable relative to the cylinder section in a direction perpendicular to the pressure receiving surface, the pressure receiving surface being in continuous fluid communication with the compressed air chamber;

a biasing member disposed between the cylinder section and the piston for urging the piston toward intake portion; and, a valve section movable integrally with the piston for selectively blocking a fluid communication between the intake portion and the pressure receiving surface.

3. The pneumatically operated power tool as claimed in claim 2, wherein the cylinder section has a closed bottom end and another open end, and wherein the valve section comprises a valve stem extending from the piston, and a valve head fixed to the valve stem; and the pressure reduction valve further comprising a holder section disposed at the another open end and formed with a through-hole for allowing the valve stem to extend therethrough, the valve head selectively closing the through-hole, the pressure receiving surface being formed with a groove facing the holder section in communication with the through hole and the compressed air chamber.

4. The pneumatically operated power tool as claimed in claim 1, wherein the passage section is formed with a linear central passage, a first branch passage branched from the central passage and in communication with the intake portion, and a second branch passage branched from the central passage and in communication with the compressed air chamber, the valve member movably extending through the central passage.

5. A pressure changing mechanism for use in a pneumatically operated power tool including an outer frame having a compressed air intake portion and defining therein a compressed air chamber, and a driving components disposed in the outer frame and driven by a compressed air in the compressed air chamber, the pressure changing mechanism comprising:

a pressure reduction valve allowing a compressed air to flow from the air intake portion to the compressed air chamber and to reduce a compressed air pressure when the compressed air is flowed through the pressure reduction valve;

a passage section provided independently of the pressure reduction valve and communicating the air intake portion with the compressed air chamber; and a valve member disposed at the passage section and linearly movable between a first position where the communication at the passage section between the air intake portion and the compressed air chamber is blocked, whereby the pressure reduction valve performs its inherent pressure reducing operation, and a second position where the air intake portion is communicated with the compressed air chamber at the passage section.

6. The pressure changing mechanism as claimed in claim 5, wherein the pressure reduction valve comprises:

a cylinder section disposed in the compressed air chamber;

a piston disposed in the cylinder section and having a pressure receiving surface facing the intake portion, the piston being slidingly movable relative to the cylinder section in a direction perpendicular to the pressure receiving surface, the pressure receiving surface being in continuous fluid communication with the compressed air chamber;

a biasing member disposed between the cylinder section and the piston for urging the piston toward intake portion; and, a valve section movable integrally with the piston for selectively blocking a fluid communication between the intake portion and the pressure receiving surface.

7. The pressure changing mechanism as claimed in claim 6, wherein the cylinder section has a closed bottom end and another open end, and wherein the valve section comprises a valve stem extending from the piston, and a valve head fixed to the valve stem; and the pressure reduction valve further comprising a holder section disposed at the another open end and formed with a through-hole for allowing the valve stem to extend therethrough, the valve head selectively closing the through-hole, the pressure receiving surface being formed with a groove facing the holder section in communication with the through hole and the compressed air chamber.

8. The pressure changing mechanism as claimed in claim 5, wherein the passage section is formed with a linear central passage, a first branch passage branched from the central passage and in communication with the intake portion, and a second branch passage branched from the central passage and in communication with the compressed air chamber, the valve member movably extending through the central passage.

* * * * *